US005842495A

United States Patent [19]

Egnew et al.

[11] Patent Number: 5,842,495

[45] Date of Patent: Dec. 1, 1998

[54] CONCEALMENT SHELTER

[75] Inventors: James C. Egnew; Larry A. Lockhart, both of Stearns, Ky.; Elvin Byrd, Jr., Oneida, Tenn.

[73] Assignee: Shelter Pro, LLC, Stearns, Ky.

[21] Appl. No.: 746,240

[22] Filed: Nov. 7, 1996

[51] Int. Cl.[6] ..... E04H 15/44

[52] U.S. Cl. ..... 135/133; 135/137; 135/144; 135/147; 135/114

[58] Field of Search ..... 135/132, 133, 135/128, 134, 130, 143, 144, 147, 151, 153, 114

[56] References Cited

U.S. PATENT DOCUMENTS

| | | | |
|---|---|---|---|
| 2,598,940 | 6/1952 | Robie . | |
| 3,513,861 | 5/1970 | Johnson | 135/132 |
| 3,794,054 | 2/1974 | Watts | 135/98 |
| 3,995,649 | 12/1976 | Robichaud | 135/133 |
| 4,116,206 | 9/1978 | Warner et al. | 135/133 X |
| 4,227,542 | 10/1980 | Bonfolio | 135/132 |
| 4,239,247 | 12/1980 | Hinz . | |
| 4,271,856 | 6/1981 | Ferguson . | |
| 4,425,929 | 1/1984 | Von Mosshaim . | |
| 4,583,331 | 4/1986 | Hunt et al. . | |
| 4,716,919 | 1/1988 | Griffin | 135/133 |
| 4,830,036 | 5/1989 | Sanders | 135/132 X |
| 4,838,294 | 6/1989 | Hunt . | |
| 4,879,848 | 11/1989 | Gardner et al. . | |
| 4,885,877 | 12/1989 | Hunt et al. . | |
| 5,013,079 | 5/1991 | Ho | 135/133 X |
| 5,085,240 | 2/1992 | Littledeer . | |
| 5,159,947 | 11/1992 | Chuang et al. . | |
| 5,590,674 | 1/1997 | Eppenbach | 135/130 |

FOREIGN PATENT DOCUMENTS

| | | | |
|---|---|---|---|
| 574681 | 4/1959 | Canada . | |
| 575138 | 5/1959 | Canada . | |
| 1009536 | 5/1974 | Canada . | |
| 2076153 | 2/1994 | Canada . | |
| 1325748 | 3/1963 | France | 135/132 |
| 1457485 | 1/1969 | Germany | 135/128 |
| 0549177 | 6/1957 | Italy | 135/132 |
| WO 80/02637 | 12/1980 | WIPO . | |

*Primary Examiner*—Lanna Mai
*Attorney, Agent, or Firm*—Luedeka, Neely & Graham, PC

[57] ABSTRACT

A portable shelter or camouflage support structure is formed by a plurality of bow formers that are pivoted at opposite bow ends for fan-like development about a substantially common axis or a cluster of parallel axes. Each bow former is having two or more rigid arc elements that are joined end-to-end by a polymer tubing splice joint with a substantial separation space between the two opposing ends of the rigid elements whereby the rotationally collapsed fan of the bow former elements is further folded upon itself to reduce the length and bulk of the structure without resort to independently attached and assembled elements.

11 Claims, 13 Drawing Sheets

CONCEALMENT SHELTER

FIELD OF THE INVENTION

The present invention relates to collapsible and highly portable structures for free-standing support of a weather shelter or concealment screen. The invention also relates to portable hunting blinds and military camouflage.

BACKGROUND OF THE INVENTION

Collapsible combinations of portable shelter structure are the traditional essence of tents, cabanas and canopies. Generally, the structure includes a waterproof or water resistant fabric held to an open, expanded position by a framework of rods or poles. The poles form the skeletal frame of a spacial geometry and the fabric covers and defines the geometry as an independent skin.

Most tent poles are perceived as a straight, slender rod elements that may be flexible or resilient. In principle, portability and speed of erection are incompatible. The poles are transported as a bundle of rods bound together with one or more wraps of the folded fabric. When erected, the poles are relatively aligned and secured together in relative position by a multiplicity of ties, joints and fasteners, each being manually aligned and connected to another pole or to the fabric.

With respect to camouflage and hunting blinds, the purpose of camouflage is deception. Camouflage serves as the means to disguise, conceal or obscure movement of people or equipment from the perception of quarry. Conventional wisdom is that the superior camouflage constructions use natural materials that are fresh in their season of use. These natural materials are distributed about the perimeter of the area that is to be concealed from observation by a designated quarry in a pattern consistent with the surroundings. Correctly executed and constructed, good hunting blinds of native materials require considerable construction time, effort and skill. Moreover, even at best, such structures or arrangements are fragile and temporary against high winds and precipitation.

One of the more effective features of natural material blinds is the use of fresh foliage that lends a natural texture to the blind with many waving surface elements. Notwithstanding printed color variations, printed fabric to synthesize foliage is discernable by its uniform light reflective angle.

It is an object of the present invention, therefore, to provide a portable shelter that is light, compact and quickly erected.

Also an object of the present invention is an extremely light weight and portable camouflage screen.

Another object of the invention is a completely unitized, portable structure combination having no independently attached components.

A still further object of the present invention is a highly portable hunting blind.

An additional object of the invention is a unitized hunting blind having flexible, textured surface elements that independently wave freely in a light breeze as natural vegetation.

SUMMARY OF THE INVENTION

These and other objects of the invention are accomplished by a skeletal structure comprising a plurality of half bows that are joined by polymer tubing. The primary shape of the structure is formed by three or more bows that radiate from a substantially common axis to define spherical sectors.

Angular separation between the bows is limited by attachment to a fabric or scrim cover. The axis end of each half bow is pivotally secured to a respective pivot plate. Half bows respective to each pivot plate are paired and joined together at: a mutual arc bight by a section of polymer tubing. Separation between the pivot plates is limited by a cord or rope element secured at opposite ends to a respective pivot plate.

The fabric or scrim cover over the skeletal structure is an assembly of gore sections. Each gore section spans the chord of a spherical sector between adjacent bows. Half bow tubes are threaded. through loops sewn into the adjacent gore seams.

Camouflage for the structure comprises a scrim substrate having a lightweight printed fabric attached to the scrim along parallel stitching seams spaced apart at 3 in., for example. The fabric is printed in traditional camouflage colors and patterns. Additionally, however, the printed fabric is cut between the stitching seams in a pattern that progresses generally parallel with the stitching but meanders transversely of the seam direction. Such meandering provides a relatively large number of fabric points and triangles that are easily lifted and waved by a light draft or wind thereby simulating foliage and obscuring movement within the structure.

The erected combination of bow framed spherical sectors angularly expanded about a common axis to sector limits defined by the fabric cover is struck by rotating the bows about the common axis (actually a cluster of parallel axes) to a position of mutual. parallelism. In this position, all of bow bights are adjacent and arced in parallel planes. So aligned, the respective, parallel half-bow sets are folded about an axis aligned transversely through the polymer tubes and generally perpendicular to the common bow axis. Such folding lays all the half-bows, with fabric attached, into bundled parallelism. Binder straps may be wrapped about the respective ends of the consolidated half bows to further compact the bundle. A shoulder carry strap may be combined with the binder straps to transport the bundle of half-bows, or, alternatively, the half bow-bundle may be enclosed within an independent cover.

In another aspect, the invention is directed to a pivot. plate joint assembly of nonrotating polymer links between a plate structure and the lower end of a rigid half-bow element. Such polymer links may be hollow plastic tubing connectors or solid plastic rod sections. Furthermore, such polymer links have an inherent spring bias and, depending on the relative fixture angle to the pivot plate and the designers discretion, may be biased to open the structure or to close it.

BRIEF DESCRIPTION OF THE DRAWINGS

The invention and its several embodiments may be more readily understood from the following detailed description that is; correlated to the accompanying drawings in which.

DETAILED DESCRIPTION OF THE EMBODIMENTS

Figure 1:
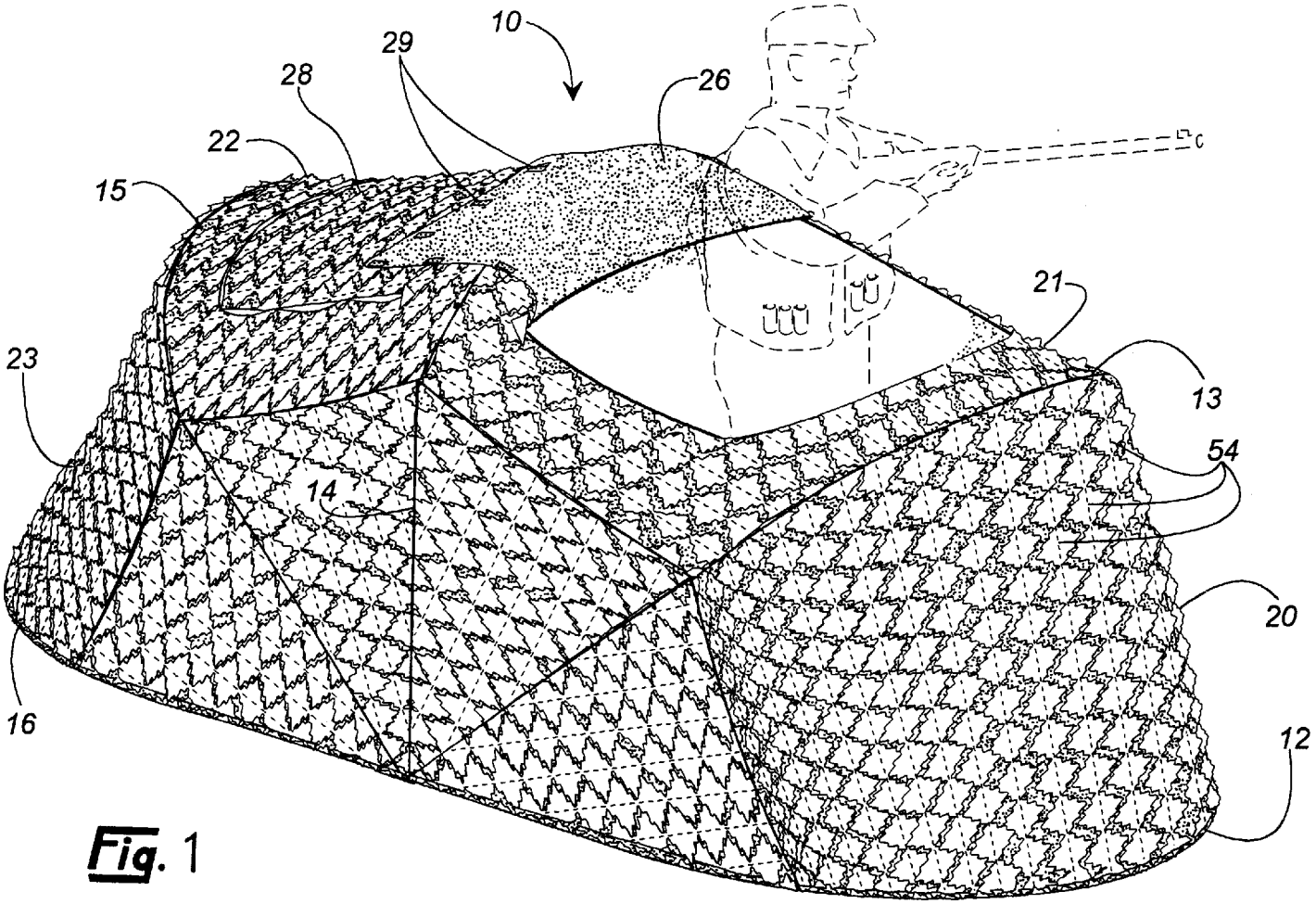
FIG. 1 is an isometric perspective of the erected invention.

With reference to the drawings wherein like reference characters designate like or similar elements throughout the several figures of the drawings, FIG. 1 illustrates an erected hunting blind 10 with five bows 12, 13, 14, 15 and 16 to delineate four substantially hemispherical sectors 20, 21, 22 and 23. The two interior sectors 21 and 22 each preferably include respective hatch flaps 26 and 28 to facilitate convenient emergence from the blind interior when desired.

Figure 2:
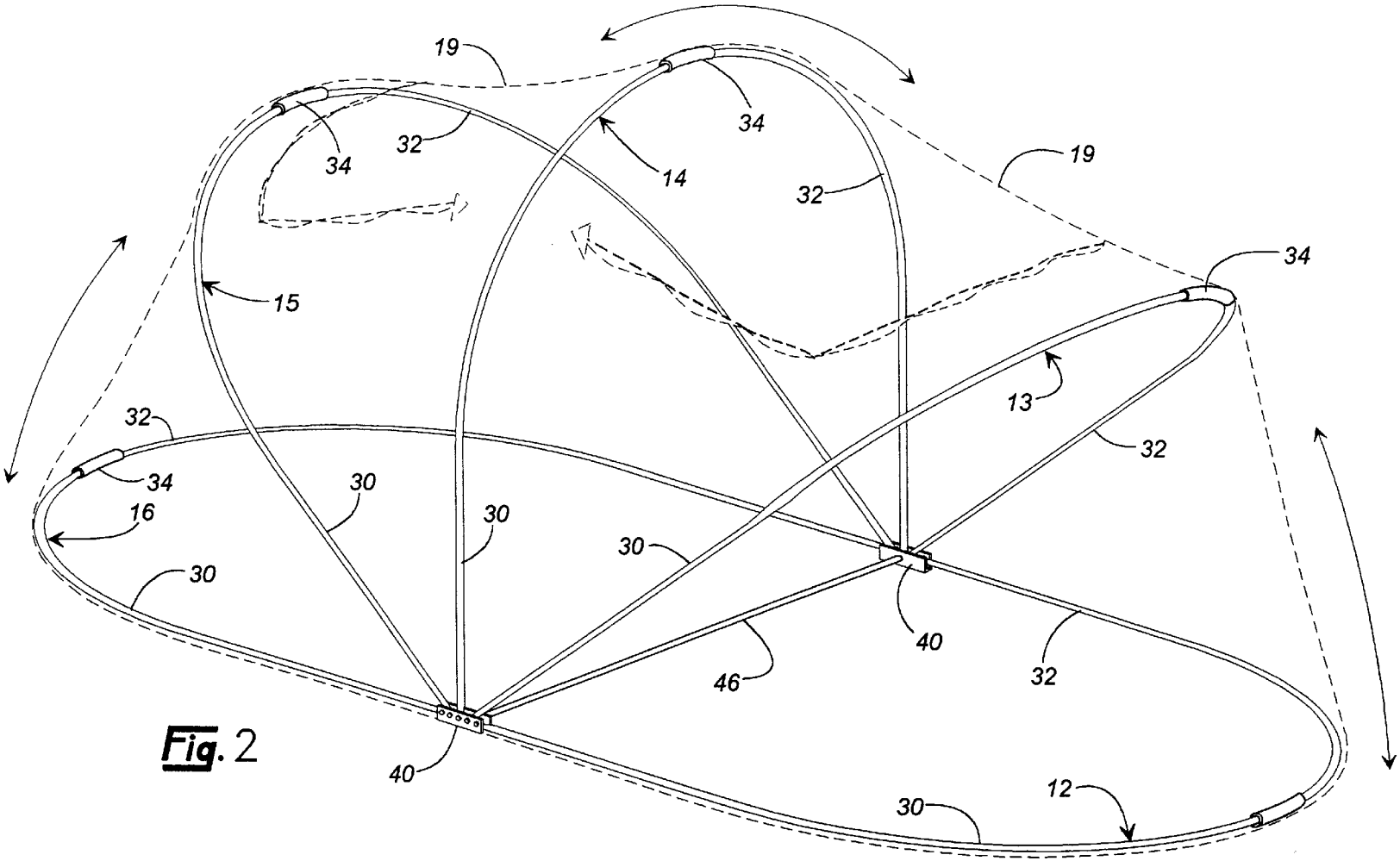
FIG. 2 is an isometric perspective of the erected frame skeleton.
Figure 7:
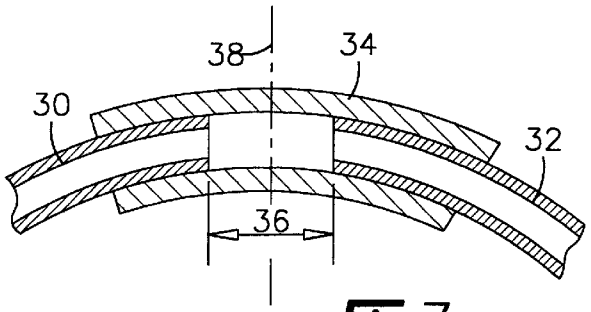
FIG. 7 is a cross-section of the half-bow joint designated by the detail area 6 of FIG. 5.

Referring now to FIG. 2 which illustrates the skeletal framework of the hunting blind. Each bow 12, 13, 14 and 15 preferably includes a pair of light, rigid half bows 30 and 32 joined in the approximate middle of an arced bight by a flexible linkage preferably comprising a section of flexible polymer tubing 34, and most: preferably, flexible vinyl tubing. Characterization of the former elements 30 and 32 as "half-bows" is not a description of limitation but merely a reference to the fact that the rigid sections of the elements serve as portions of a full bow arc. With respect to the cross-section of FIG. 7, the half-bows 30 and 32 are preferably fabricated of approximately ½ in. outside diameter (O.D.) aluminum pipe having an approximately 1/16 in. wall thickness. The flexible vinyl tubing 34 size is selected for a snug push-fit over the half-bow elements. Adequate overlap normally obviates the necessity for external clamps to secure the flexible tubing 34 over the half-bow ends. However, clamps or adhesives may be used if desired. A space 36 between the opposing half-bow ends of about two to about four half-bow tube diameters is preferred to accommodate relative rotation of the half-bows 30 and 32 about an axis 38 transversely through the space 36. Such distance is more appropriately determined by the mechanical stiffness properties of the tubing and the tubing wall thickness.

Due to the considerable compliance of the vinyl tube section 34, the frame bows 12–16 need not conform to a true circular arc but may also approximate an ellipse, vaulted arch or the like.

Figure 5:
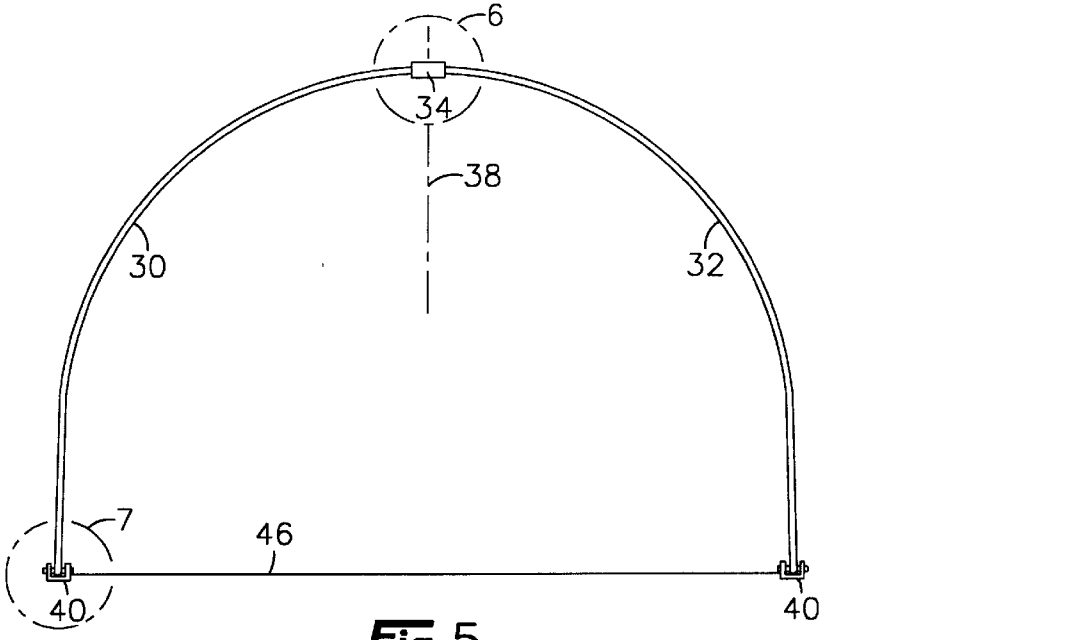
FIG. 5 is a front elevation of a first embodiment of the invention.
Figure 8:
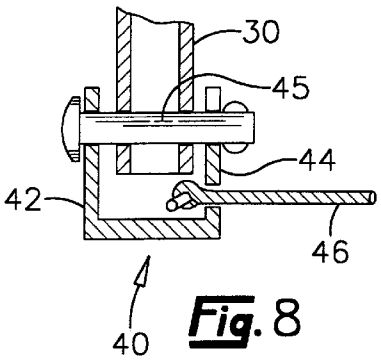
FIG. 8 is a cross-section of the pivot plate joint designated by the detail area 7 of FIG. 5.

The lower ends of the half-bows 30 and 32 are pivotally secured to pivot plates 40 in a manner such as shown by FIG. 8 wherein the plate 40 is a structural channel member having side walls 42 and 44 for supporting opposite ends of a rivet 45 which passes through an aperture in a respective half-bow 30 as a journal bearing for example. Note also from FIGS. 5 and 8 that the pivot plates 40 respective to the two half-bows 30 and 32 may be tethered together by a tensile structural element such as a light cable 46, cord or rope to limit the distance that the two pivot plates 40 may separate but readily collapses when the pivot plates are moved toward each other. As will be appreciated, this is advantageous to enable compact tent folding and at the same time, highly effective to define and secure the erected shape of the framework.

Figure 4:
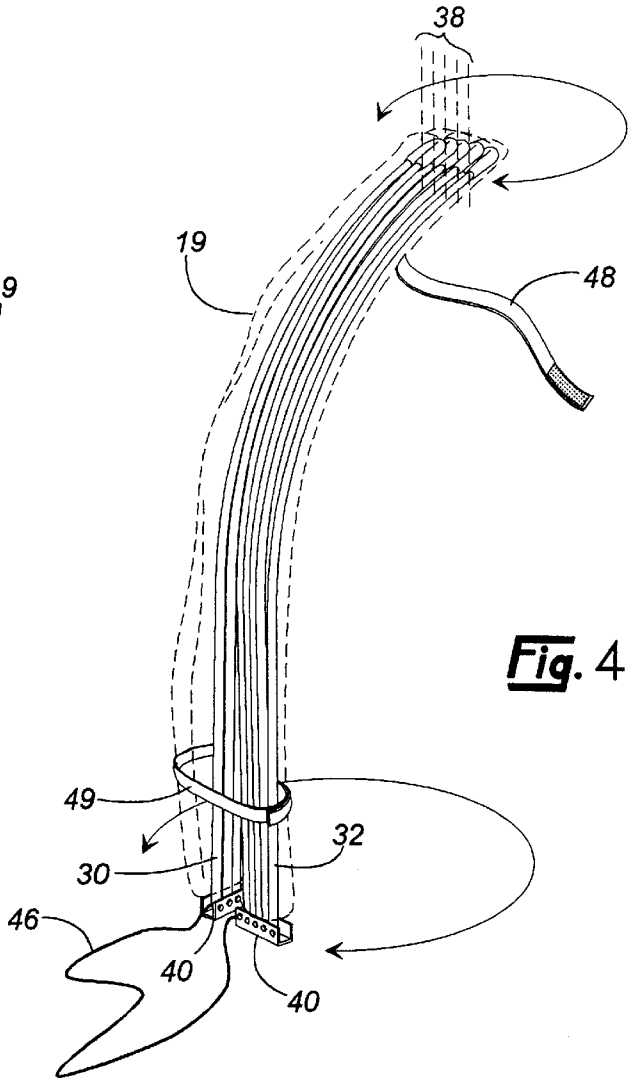
FIG. 4 is an isometric perspective of the collapsed and folded frame skeleton.
Figure 3:
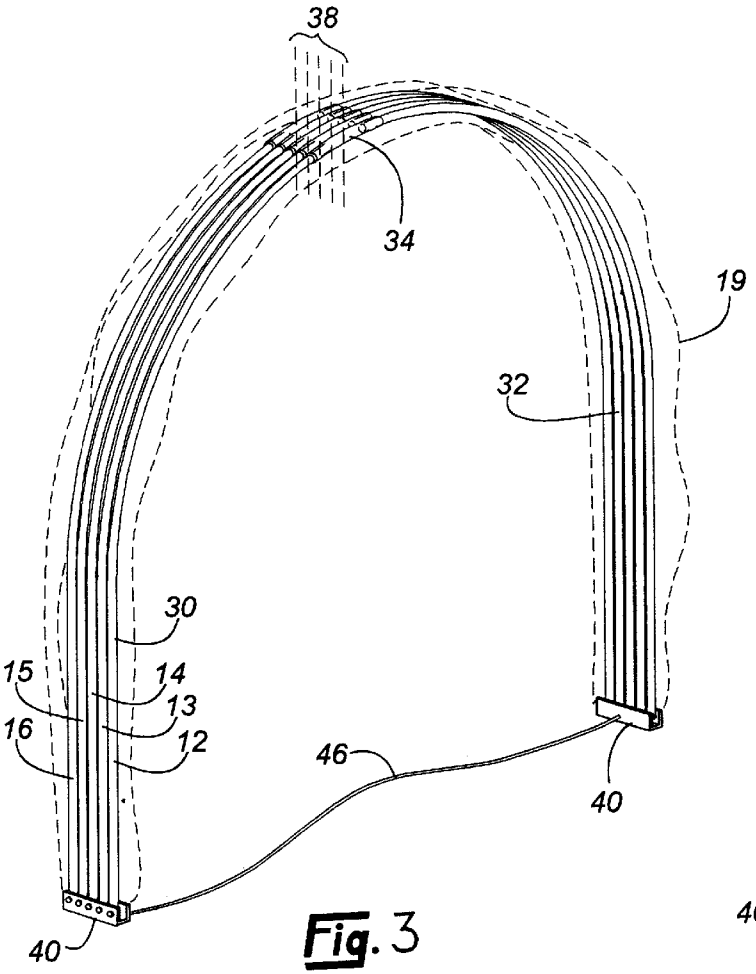
FIG. 3 is an isometric perspective of the partially collapsed frame skeleton.

With respect to FIG. 3, the previously described bows 12–16 are rotated about respective pivot rivets 45 to a collapsed condition of substantial parallelism. In the disposition shown by FIG. 3, the two half-bow sets 30 and 32 may then be rotated about respective axes 38 to adjacent alignment as illustrated by FIG. 4. In this alignment, the two ends of the folded bows are cinched by straps 48 and 49.

The half-bows 30 and 32 have been described as preferably comprising aluminum tubing that has been formed to an arc. Suitable or even superior alternatives may include polymer tubing that: integrates structural reinforcing fiber or filament such as graphite or fiberglass wound into the tubing wall and cured to an arcuate form. obviously, mechanically formed thin-wall steel alloy tubing could be another metallic tubing alternative. It is also possible to produce rigid polymer tubing in a bow shape by thermoextrusion onto a curved support surface. A more traditional alternative to the preferred mechanically formed aluminum tube for some applications may be laminated or steam formed wood bows. Although circular section tubing has been described as the preferred structural shape of the half-bows 30 and 32, it will be recognized that any rod-like shape that will retain the arc distinctive to the half-bows is suitable. This could include squares and ovals, solids and tubes and H-sections. Regardless of the cross-sectional shape of the half-bow rods, such rods will have an effective diameter that will correspond to a snug fit of the flexible polymer linkage 34.

Connecting all of the bows 12–16 together is a skin comprising as many gores as sectors 20, 21, 22 and 23. The gores are seamed together along the forming lines defined by respective bows 12–16. Integrated with the skin gore seams are loops, not shown, for confining the length and angular position of the bows 12–16 to the skin along the gore seam line.

The skin material characteristics may be typical for a moisture shedding tent having the purpose of a temporary shelter from the fundamental elements of nature. Such suitable skin materials include traditional sailcloth or tent material which is a paraffin treated fabric woven of natural fiber. Also suitable are water repellant or resistant fabrics woven from polymer yarn or monofilament thread. Certain applications may find a polymer film such as Mylar or polyvinyl chloride to be useful. Any or all of these water repellant materials may be dyed, woven or painted in camouflage colors and patterns.

Also in the case of a water repellant shelter, it may be desirable to include no door or other interruption of a gore continuity. Sized for one or two person occupancy, the invention shelter may be entered and vacated by rotating either of the ground engaging bows 12 or 16 about its respective pivot axis which approximately corresponds to the transverse cable 46. Although the invention is stable in the open, expanded status illustrated by FIG. 1, it should be understood that the total weight of the shelter, depending on the materials used and techniques of construction, may be considerably less than ten pounds. Considering the volume and surface area of a two person shelter supporting only a ten pound mass, it will be appreciated by those of skill in the art that unless secured to firmament such as the ground, rocks or trees, the shelter may be easily displaced by only a light wind or small animals. For this reason, some form of anchorage may be desired. However, unlike the external perimeter pegging of a traditional tent, it may be more appropriate to peg or otherwise anchor the structure perimeter on the inside. With the two pivot plates 40 and the ground bow 16 securely anchored to the ground by means of pegs or ties to rocks, for example, the ground bow 12 may be easily lifted for entry and exit of the shelter interior. Accordingly, no door opening in the tent skin is either required or desired.

Furthermore, when deployed as described above, it will also be appreciated that the ground bow 12 may be rotated to adjacency with the interior bow 13 and secured by tieing the two bows together or by independent prop supports from the ground. In this disposition, the invention provides an openly ventilated canopy such as an awning or cabana.

Used as a hunting blind or military camouflage, the structural skin of the invention acquires a distinctive function having no relevance to wind or water repellency. Such an embodiment: of the invention includes a skin of irregularly and variably textured camouflage such as that illustrated in relevant portion by FIG. 9. In this case, the structural functions of the skin are carried by a coarsely woven scrim material 50. Overlying the scrim 50 is a lightweight fabric 52 of more dense weave, 3 oz. per yd$^2$, for example. The overlay fabric 52 is preferably printed in camouflage colors and patterns such as leaves, limbs and other foliage. A preferred fabric is available from Milliken & Co. of Spartanberg, S.C. under the tradename INTRIGUE®. This product is marketed in several camouflage colors and patterns, one of which carries the trademark identity of ADVANTAGE®. Overlay fabric 52 and scrim 50 are secured together by widely spaced, parallel stitch lines 54. A 3 inch separation between stitch lines is representative. With the fabric 52 stitched into overlaid lamination with the scrim 50, the camouflage fabric 52 is cut along a meandering line 56. In this case, meandering means that the general course of cut line 56 follows a parallel between adjacent stitch lines 54. However, as the line 56 advances parallel to and between the stitch lines 54, it also traverses the stitch line direction to generate loose, leaf-like areas 58 that are easily waved by light wind currents. A random and dynamic lay of the leaf-like areas 58 provides a variable surface texture to the skin of the invention hunting blind.

Operating cooperatively with the camouflaged scrim covering are a pair of hatch-like flaps 26 which may be closed and secured by Velcro type hook and loop fasteners 29 or laid back openly as illustrated by FIG. 1. Of course, hatch flaps 26 may also be applied to the weather resistant embodiment of the invention but would preferably be secured in place by a moisture turning closure element such as a flap overlaid zipper or a plastic, tongue-in-channel closure.

Figure 6:
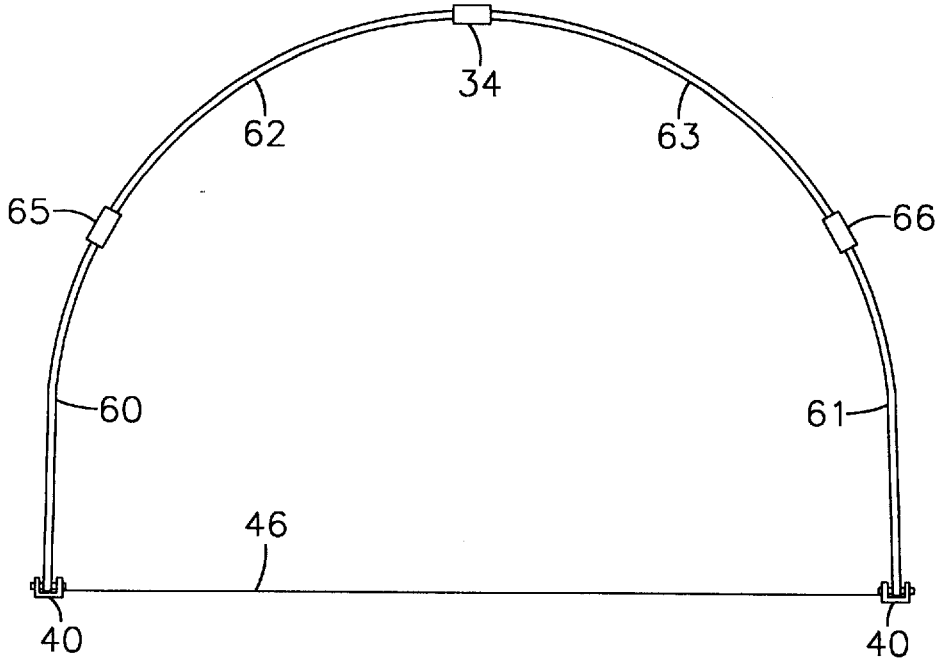
FIG. 6 is a front elevation of a second embodiment of the invention.
Figure 10:
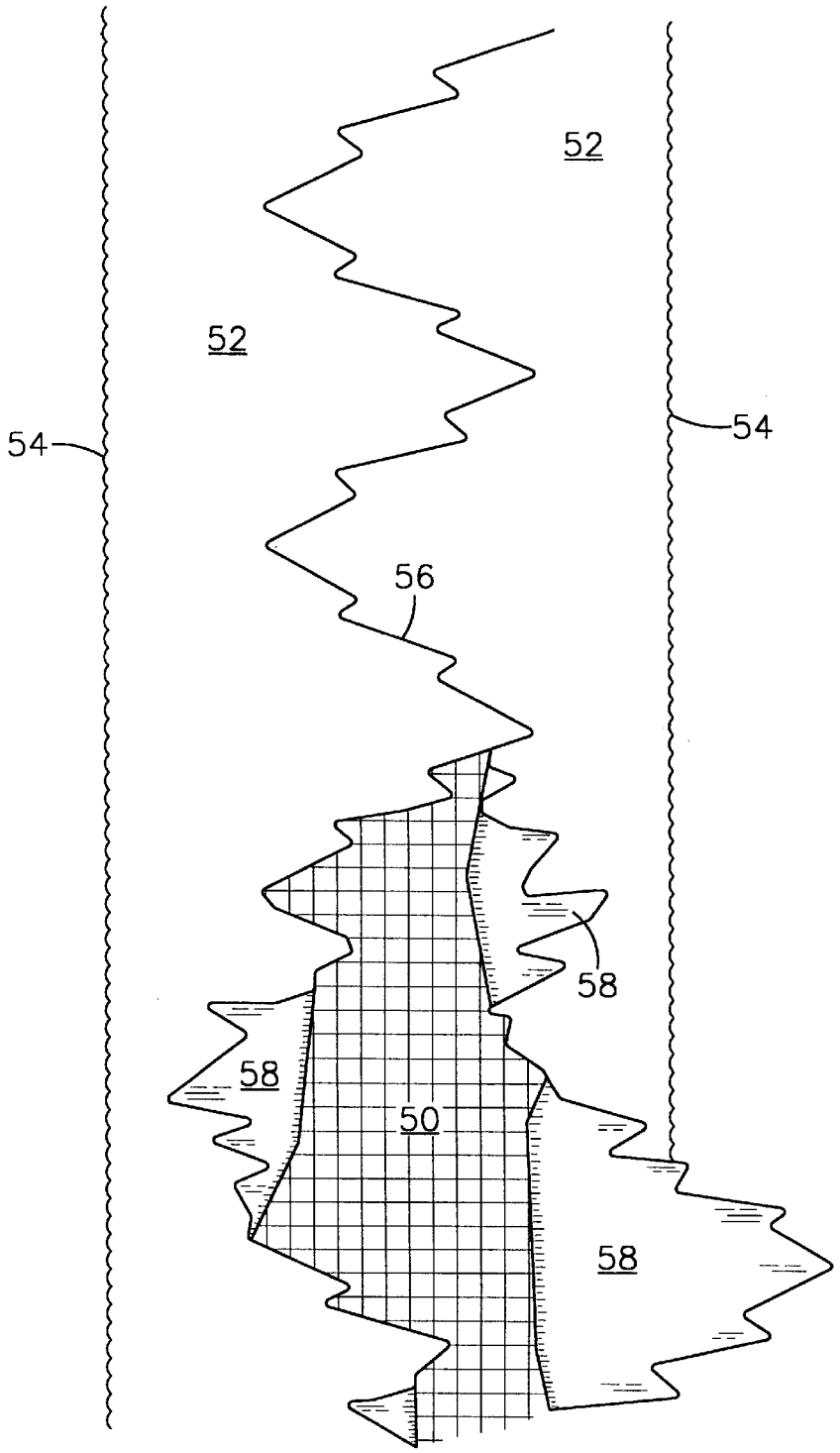
FIG. 10 is a plan view of the camouflage covering composite.

The synergistic utility of the flexible linkage 34 as a structural connector and as a resiliently biased hinge is expanded by the FIG. 6 embodiment of the invention. This embodiment teaches a bow assembly comprising four rigid tube units 60, 61, 62 and 63 that are butt joint connected by three polymer tube section connectors 34, 65 and 66. Extrapolating from the FIG. 4 model of the invention, the lower section rigid tube units 60 and 61 are respectively folded about the joints 65 and 66 to adjacent parallelism with the upper rigid tube units 62 and 63. Finally, the folded half-bow units are folded together about tube joints 34 and cinched by straps such as 48 and 49 of FIG. 4. An invention embodiment such as is represented by FIG. 6 may be exploited as a 4-person tent, a portable auto garage or as camouflage for military combat equipment.

Figure 11:
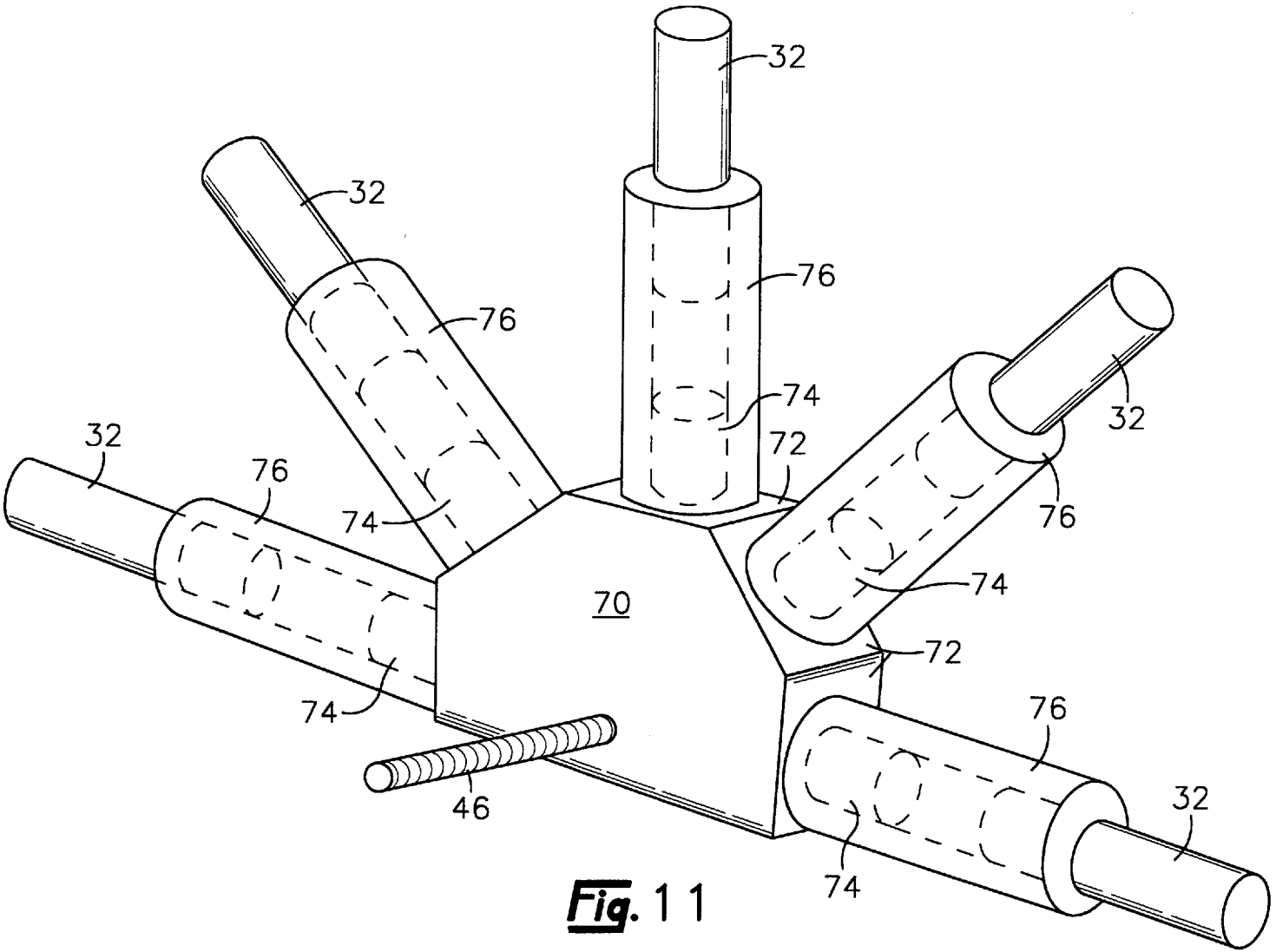
FIG. 11 is a second embodiment of the invention pivot plate in the open, expanded position.
Figure 12:
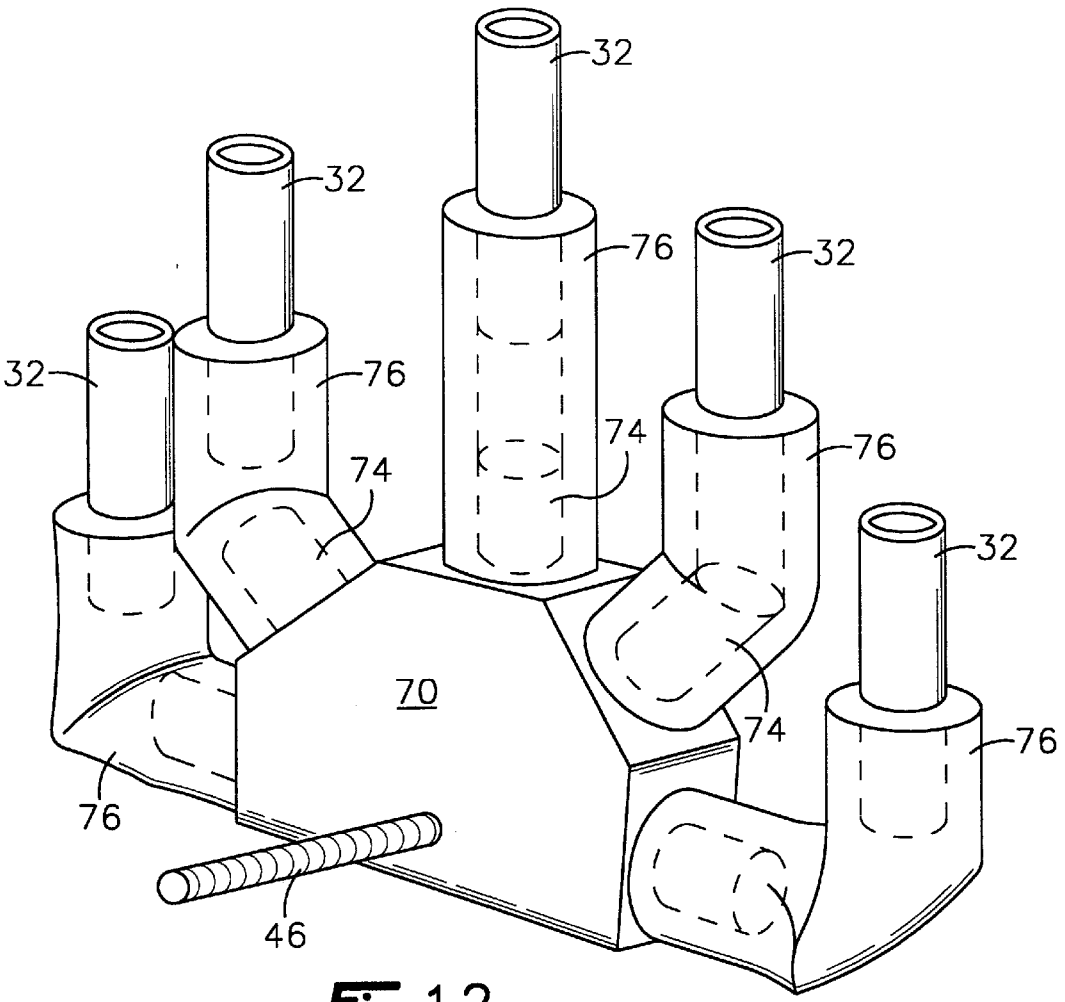
FIG. 12 is a second embodiment of the invention pivot plate in the closed position.

FIGS. 11 and 12 illustrate an embodiment of the invention wherein the polymer tube connector-pivot concept is applied in lieu of a pivot plate 40. This embodiment comprises a junction block 70 having five facets 72, for example, each set at an angle normal to a respective bow angle. From each facet, a cylindrical pin 74 projects along the corresponding axis of half-bow 32. Sections of flexible polymer tubing 76 are pushed over the opposing ends respective to the half-bows 32 and pins 74. As with the pivot tubing joints 32, about two bow-tube diameters are left between the half-bow and pin ends. Inherent resiliency of the flexible polymer material will bias the respective half-bows 32 toward their assigned angular alignment so that erection of the compact, folded unit requires little more than release of the cinch straps 48 and 49. The resilient bias of the several pivot joints inherently expand the structure to a completely erect unit except for anchoring.

Reference to FIG. 12 illustrates the junction block 70 unit folded to the collapsed position corresponding to the folded disposition of the FIG. 4 and FIG. 8 journal pivot embodiment. Note should be taken of the collapsed, compressed disposition of the FIG. 11 polymer tube elements 76 which, when folded, are resiliently stressed, internally, from a stable, cylindrical form. Such internal stress biases the bows 12–16 to the expanded, erect disposition. Retainer straps 48 and 49 (FIG. 4) hold the bow elements in the collapsed position against the bias of stressed tube elements 76.

Figure 13:
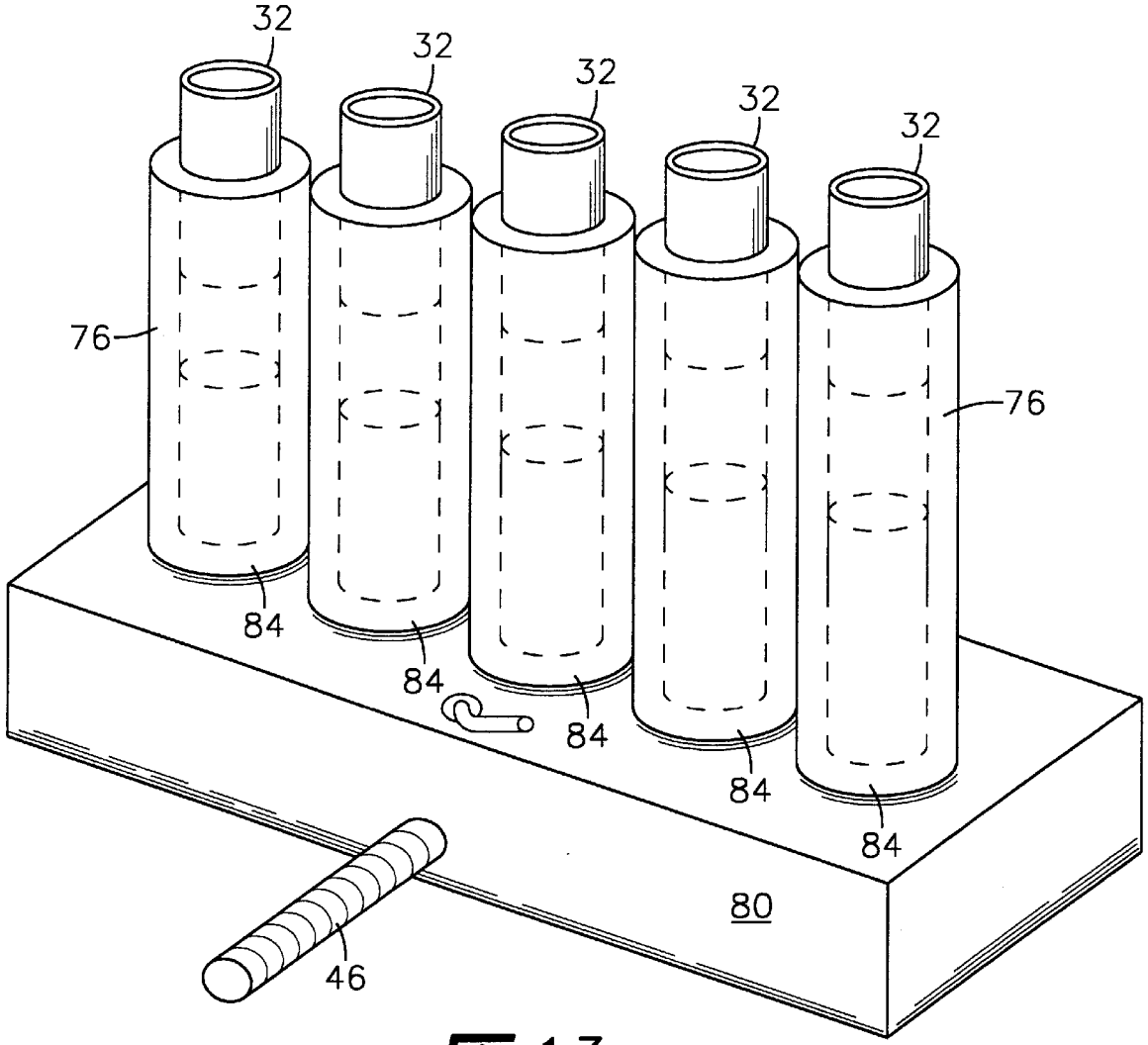
FIG. 13 is a third embodiment of the invention pivot plate in the open position.

A comparatively opposite result is obtained from the FIG. 13 embodiment having a straight base junction block 80 supporting parallel pins 84. Flexible polymer tube sections 76 connect the half-bow ends 32 to the parallel pins 84. This FIG. 13 embodiment of the invention applies the resilient bias of the tube sections 76 tc the collapsed, stowed condition of the bows 12–16. Accordingly, the bows are rotated to the open position as shown by FIG. 1 against the bias of tube sections 76 and therefore would require some form of anchorage or bracing at that open position. on the other hand, striking the tent is simply a matter of releasing the anchorage.

Figure 9:
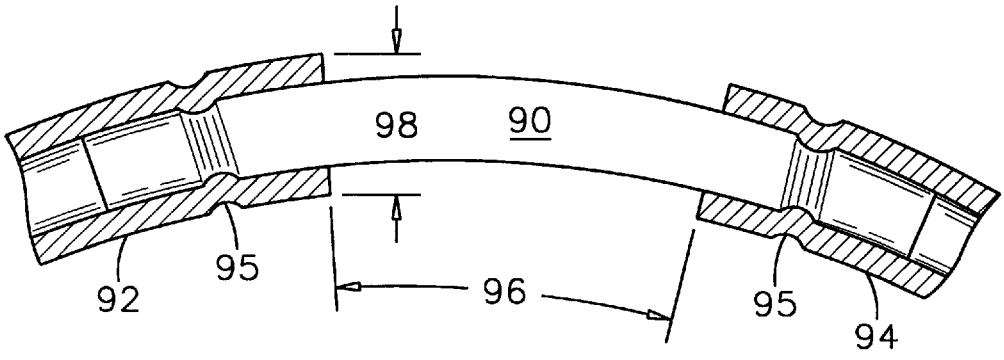
FIG. 9 is a partial cross-sectional view of an alternative embodiment of the half-bow pivot joint.

FIG. 9 illustrates another variation on the flexible joint connecting adjacent rigid half-bow sections. In this case, a solid rod section 90 of flexible polymer is inserted into the bore openings of cooperative half-bows 92 and 94 of tubing and secured by clamping, crimping or adhesive, depending on the material characteristics of the half-bows. As with the flexible tubing joints, a distance 96 of about two to about four diameters 98 is allowed between opposing half-bow ends. As illustrated by FIG. 9, the half-bow 92 and 94 material is metallic and adapted to mechanically conform to a rolled crimp 95 which secures the polymer rod 90 within the half-bow bores by material displacement and interference.

Figure 14:
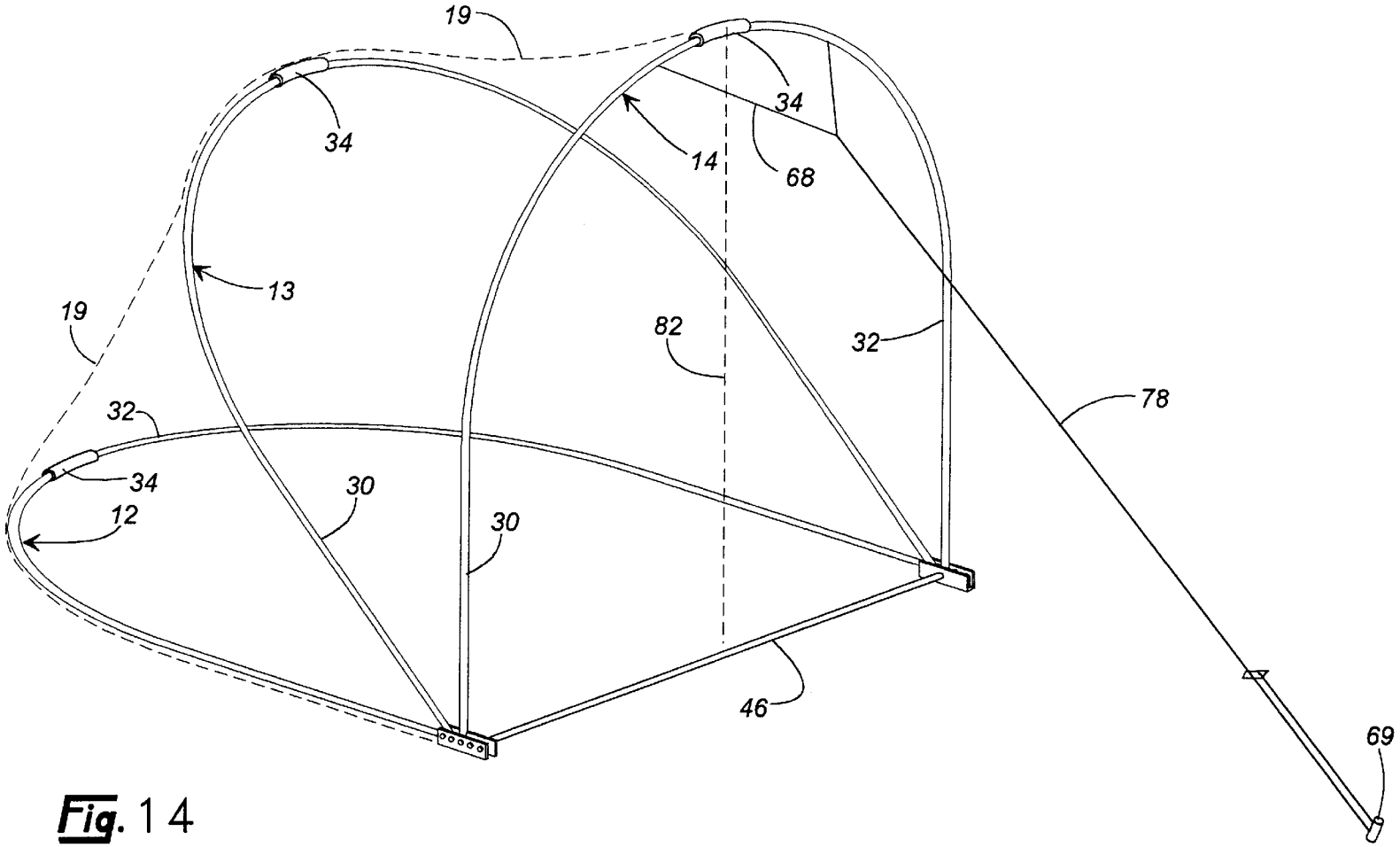
FIG. 14 is an isometric perspective of a 3-bow cabana embodiment of the invention.

FIG. 14 illustrates an extremely lightweight cabana embodiment of the invention that may be advantageously used as a 1-man shelter or blind. Only three bows, 12, 13 and 14 are needed. A lightweight guy line 78, anchored to the ground by a tent stake 69 and secured to the vertical bow 14 by a harness 68, secures the vertical bow 14 against tension in the covering skin 19. The horizontal or ground bow 12 is secured in place against the guy line force by stakes or rocks not shown. Vertical centerline 82 represents a vertical curtain secured around the rim of bow 14 to drape across the vertical plane defined by the bow 14. Preferably, the curtain is divided along the centerline 82 into at least two sections that may be folded back over the outside surface of the structure when desired. Closure of the two curtain sections may be secured by Velco tabs, not shown, or by a zipper type fastener. With the curtain sections folded back, this cabana embodiment of the invention is particularly useful as a dove or turkey hunting blind.

Figure 15:
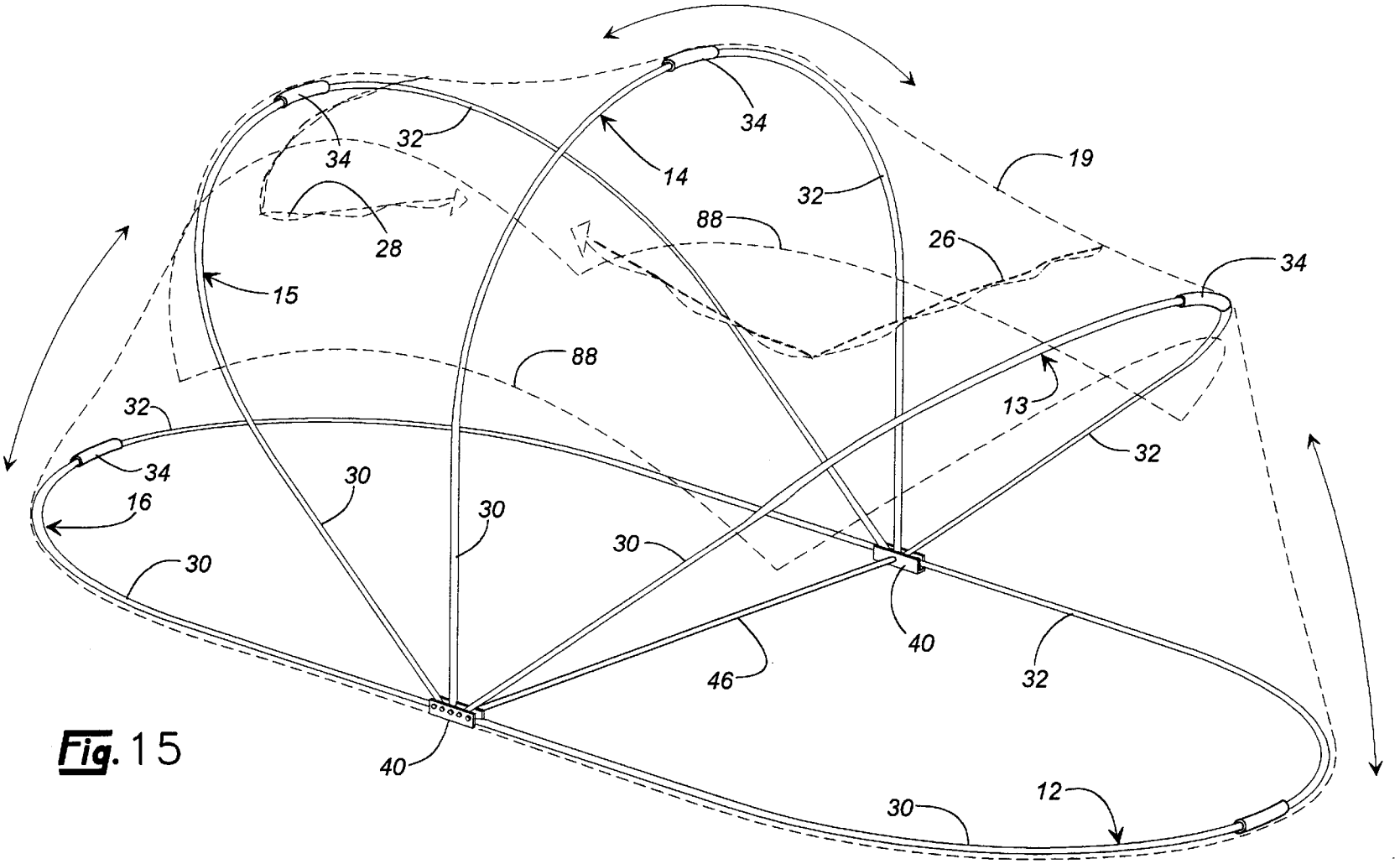
FIG. 15 is a weather and water resistant embodiment of the invention.

FIG. 15 illustrates an expansion of the FIG. 2 invention embodiment utility by means of a weather resisting cap or outside liner 88. As an independent and detachable element, the cap 88 may be a sheet of water proof or water resistant fabric or film draped over the interior bows 13, 14 and 15 to cover the hatches 26 and 28. The perimeter of the cap may be secured against wind displacement by Velco type fasteners not shown. Alternatively, the weather cap 88 may be secured along one of the bows 13, 14 or 15 and rolled in preparation to strike the structure.

Figure 16:
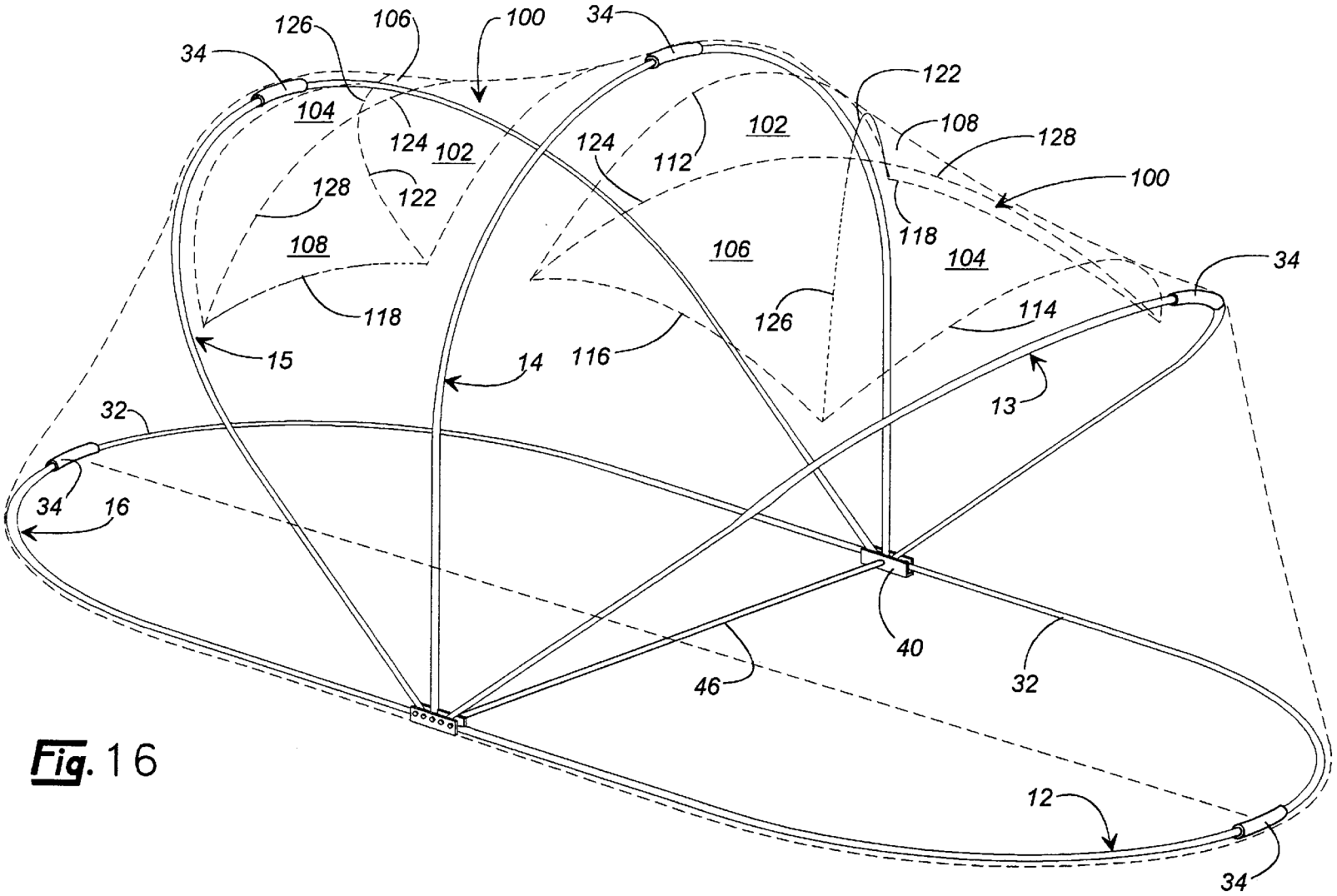
FIG. 16 is large hunting blind or shelter embodiment of the invention having quick opening hatch areas of adequate width for two or more hunters from each hatch.

The invention embodiment of FIG. 16 illustrates a larger configuration dimensioned to accommodate four waterfowl hunters: two hunters emerging from each of two hatch areas 100. Covering each these hatch areas 100 are four triangular flaps 102, 104, 106 and 108. Functionally, flap 102 is the uppermost flap regarding the rain shedding routes over the structure and flap 104 is the lowermost. With respect to the broken lines of FIG. 16, line 112, 114, 116 and 118 along the hatch 100 perimeter, these are flap base lines along which the respective flaps fold or drape downwardly when released. Each flap body is continuous with the structure 16 across these base lines.

Figure 17:
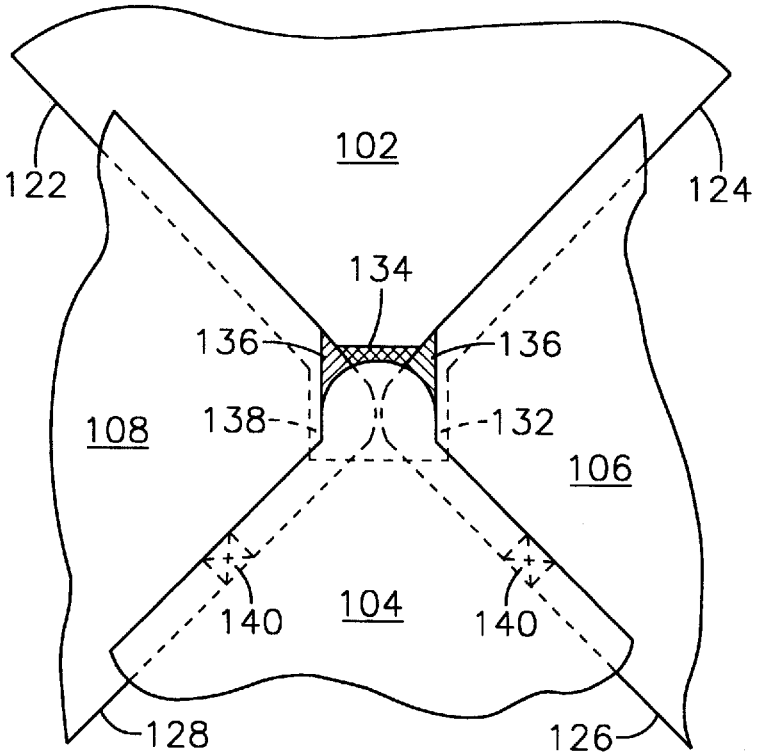
FIG. 17 is a weather resistant closure for the hatch flaps of FIG. 16 as viewed from within the structure.

Parting lines 122, 124, 126 and 128 correspond to the free sides of the four triangular flaps respective to each hatch 100 and the line of closure between the flaps. Flap closure is secured by means of the assembly of FIG. 17 which illustrates the flap apex convergence as viewed from the hatch underside within the shelter structure. The upper flap 102 is dimensioned to overlay the side flaps 106 and 108 along the edges 122 and 124. Similarly, the lower edge 126 of side flap 106 overlays the adjacent edge of bottom flap 104. Likewise, the lower edge 128 of side flap 108 overlays the adjacent edge of bottom flap 104.

These four flaps are secured in the water shedding shingle position by means of hook and loop fasteners at each flap apex. The square apex tab 132 of upper flap 102 is provided with an area 134 of loop material. The upper apex faces of side flaps 106 and 108 are provided with corresponding areas of hook material, not shown, to engage and adhere with the loop material on the tab 132. Side flaps 106 and 108 also have areas 136 of loop material on the bottom sides of their respective apices. The round apex tab 138 of bottom flap 104 is provided with an area of hook material not shown for engaging the loops of areas 136. In addition, hook and loop areas 140 between the bottom and side flaps along parting lines 126 and 128 are provided to hold the flap assembly together subject to rapid disassembly.

When desired, the round tab 138 may be disengaged from the loop material 136 of the side flaps while the fastener areas 140 hold the bottom flap 104 substantially in place. If a hunter under flap 106, for example, wishes to quickly emerge from the blind, he needs only to peel the 106 flap apex away from the loop material area 134 and that of area 140. So released, the flap 106 will fold down about base line 116 permitting the hunter to rise above the shelter line.

Further variations on the inventive concepts described herein will be apparent to those of ordinary skill in the art. To define the scope of our invention, therefore:

We claim:

1. A portable structure having a framework comprising:

a plurality of curved bow elements, each element having first and second distal ends, the first distal ends of said plurality being secured to first pivot means for articulation about substantially parallel first axes, the second distal ends of said plurality being secured to second pivot means for articulation about substantially parallel second axes, each of said bow elements comprising at least a pair of substantially rigid, curved rod-like segments having an effective rod diameter, said segment being joined at contiguous ends thereof by a flexible polymer linkage element, said linkage element having a length between said contiguous ends of said rod-like segments of at least about two effective rod diameters;

rope-like means secured to both of said first and second pivot means to limit a separation distance therebetween whereat said first axes substantially coincide with said second axes; and covering means secured to said bows to limit angular separation of said bows about said first and second axes when said first axes substantially coincide with said second axes and said contiguous ends respective to the rod segments of each bow element are oppositely separated by at least about two effective rod diameters.

2. A portable structure as described by claim 1 wherein each of said first and second distal ends are secured to said first and second pivot means, respectively, by independent journal pivots.

3. A portable structure as described by claim 1 wherein said flexible polymer linkage elements comprise polymer tubing sections to overlap contiguous ends of said rod segments.

4. A portable structure as described by claim 1 wherein said rigid curved rod-like segments comprise curved lengths of tubing.

5. A portable structure as described by claim 4 wherein said rigid curved rod-like segments comprise lengths of mechanically formed metallic tubing.

6. A portable structure as described by claim 4 wherein said rigid curved rod-like segments comprise lengths of extruded plastic tubing.

7. A portable structure as described by claim 4 wherein said rigid curved rod-like segments comprise lengths of polymer tubing reinforced with wound structural fiber.

8. A portable structure having a framework comprising:

a plurality of curved bow elements including an arced bight between respectively opposite first and second distal ends to define respective bow planes, the plurality of bow element first distal ends being pivotally secured to a first joint means for articulation about respective substantially parallel, first axes, the plurality of bow element second distal ends being pivotally secured to a second joint means for articulation about respective substantially parallel, second axes, said bow planes being pivotable about said first and second axes to a position of substantially mutual parallelism, said bows being collectively pivoted while in said position of substantially mutual parallelism about respective, substantially parallel third axes that are substantially parallel with said bow planes and substantially perpendicular to said first and second axes at a position substantially between said distal ends to fold said parallel bow planes to an adjacent alignment of said first and second joint means for compact portability.

9. A portable structure as described by claim 8 wherein separation of said first and second joint means is limited by rope-like means secured to each of said joint means.

10. A portable structure as described by claim 9 further comprising covering means secured to said bow elements to limit angular separation of said bow planes about said first and second axes.

11. A portable structure as described by claim 8 wherein said bow elements are substantially rigid between said third axis and said first and second joint.

* * * * *

UNITED STATES PATENT AND TRADEMARK OFFICE

CERTIFICATE OF CORRECTION

PATENT NO. : 5,842,495

DATED : December 1, 1998

INVENTOR(S) : James C. Egnew, et al.

It is certified that error appears in the above-identified patent and that said Letters Patent is hereby corrected as shown below: On the title page, Item [57], In the Abstract In line 5, delete "having" and insert therefore --comprised of--.

Column 2, line 42, following the phrase "to a pivot." delete the period (.).

Column 3, line 21, delete "is large" and insert therefor --is a large--.

Column 4, line 26, delete "obviously" and insert therefor --Obviously--

Column 6, line 44, delete "on the other hand" and insert therefor --On the other hand--.

Signed and Sealed this

Sixth Day of July, 1999

Attest:

Q. TODD DICKINSON

Attesting Officer

Acting Commissioner of Patents and Trademarks